US009493217B2

(12) United States Patent
Labrugere

(10) Patent No.: US 9,493,217 B2
(45) Date of Patent: Nov. 15, 2016

(54) FLOATING OFFSHORE FACILITY AND A METHOD FOR DRILLING A WELL

(71) Applicant: TOTAL SA, Courbevoie (FR)

(72) Inventor: Philippe Labrugere, Pau (FR)

(73) Assignee: TOTAL SA, Courbevoie (FR)

( * ) Notice: Subject to any disclaimer, the term of this patent is extended or adjusted under 35 U.S.C. 154(b) by 0 days.

(21) Appl. No.: 15/096,361

(22) Filed: Apr. 12, 2016

(65) Prior Publication Data

US 2016/0221648 A1 Aug. 4, 2016

Related U.S. Application Data

(63) Continuation of application No. 14/351,434, filed as application No. PCT/EP2012/070614 on Oct. 18, 2012, now Pat. No. 9,341,025.

(60) Provisional application No. 61/548,339, filed on Oct. 18, 2011.

(51) Int. Cl.

| | |
|---|---|
| ***E21B 7/12*** | (2006.01) |
| ***B63B 35/44*** | (2006.01) |
| ***E21B 19/00*** | (2006.01) |
| ***E21B 33/064*** | (2006.01) |
| ***E21B 15/02*** | (2006.01) |

(52) U.S. Cl.

CPC ..... *B63B 35/4413* (2013.01); *E21B 7/12* (2013.01); *E21B 15/02* (2013.01); *E21B 19/004* (2013.01); *E21B 33/064* (2013.01)

(58) Field of Classification Search

CPC .. E21B 33/038; E21B 33/035; E21B 43/017; E21B 43/14; E21B 19/004

USPC ..... 166/338, 344, 352, 358, 366; 405/223.1, 224, 224.2, 201; 175/5

See application file for complete search history.

(56) References Cited

U.S. PATENT DOCUMENTS

| | | | |
|---|---|---|---|
| 4,470,721 | A | 9/1984 | Shotbolt |
| 4,819,730 | A | 4/1989 | Williford et al. |
| 5,135,327 | A | 8/1992 | White et al. |
| 9,051,783 | B2 | 6/2015 | Croatto |
| 2004/0231857 | A1 | 11/2004 | Kainer et al. |

(Continued)

FOREIGN PATENT DOCUMENTS

| | | |
|---|---|---|
| FR | 2747728 | 10/1997 |
| WO | WO 2008/118914 | 10/2008 |
| WO | WO 2009/134125 | 11/2009 |
| WO | WO 2013/062737 | 5/2013 |

OTHER PUBLICATIONS

International Search Report for PCT Application PCT/EP2012/070614, mailed Oct. 18, 2013, 2 pgs.

(Continued)

*Primary Examiner* — Matthew R Buck
*Assistant Examiner* — Patrick Lambe
(74) *Attorney, Agent, or Firm* — Patterson Thuente Pedersen, P.A.

(57) ABSTRACT

A floating offshore facility for offshore hydrocarbon production, comprising an upper deck, a lower deck, a well bay comprising a plurality of drilling slots and a plurality of production slots surrounding said drilling slots, a cart supporting a drilling riser and being movable together with said drilling riser inside the opening of the plurality of the drilling slots, and a drilling rig movable above the well bay to drill the well through the drilling riser.

16 Claims, 6 Drawing Sheets

(56) References Cited

U.S. PATENT DOCUMENTS

| | | | |
|---|---|---|---|
| 2013/0098627 | A1 | 4/2013 | Jordan et al. |
| 2014/0231089 | A1 | 8/2014 | Labrugere |
| 2014/0318863 | A1 | 10/2014 | Labrugere |

OTHER PUBLICATIONS

Application and File History for U.S. Appl. No. 14/329,361, filed Jul. 11, 2014, inventor Philippe Labrugere.

Application and File History for U.S. Appl. No. 14/351,434, filed Apr. 11, 2014, inventor Philippe Labrugere.

FLOATING OFFSHORE FACILITY AND A METHOD FOR DRILLING A WELL

PRIORITY CLAIM

The present application is a National Phase entry of PCT Application No. PCT/FR2012/070614, filed Oct. 18, 2012, which claims priority from U.S. Provisional Patent Application No. 61/548,339, filed Oct. 18, 2011, said applications being hereby incorporated by reference herein in their entirety.

FIELD OF THE INVENTION

The present invention concerns a floating offshore facility for offshore hydrocarbon production.

BACKGROUND OF THE INVENTION

The present invention concerns more precisely a floating offshore facility for offshore hydrocarbon production.

For the production of hydrocarbon from deep water wells, a tension leg platform (TLP) can be used. A TLP is a floating structure tethered to the seafloor so as to eliminate the heave movement of the structure. The wells drilled into the seafloor are linked to production equipments situated above the floating structure via a plurality of production risers (tubes). The valves (trees) are therefore located out of the sea water inside the dry environment of the floating facility. Thanks to these dry trees, the maintenance on the wells as well as the well interventions are made easier.

Some TLP can accommodate a drilling rig to drill and complete the wells and to perform maintenance operations required inside the wells.

It is known to provide a drilling rig which can be moved over the upper deck to be brought to at least two different positions on the floating facility. It is therefore possible to drill a plurality of wells from the facility, said wells being separated from each other of a predetermined maximum distance.

According to a used method, the drilling riser and blow out preventer device that is installed at a first position are disconnected and removed to install them at a second position. However, this method takes a lot of time and is costly.

According to another method, the facility is equipped with two drilling risers and two blow out preventer devices. However, these equipments are costly.

OBJECTS AND SUMMARY OF THE INVENTION

One object of the present invention is to provide a floating offshore facility that is able to drill under the seafloor a plurality of wells that are distant from each other.

To this effect, a floating offshore facility for offshore hydrocarbon production according to an embodiment of the invention comprises:

an upper deck and a lower deck, a well bay located on the lower deck, said well bay being composed of a plurality of drilling slots and a plurality of production slots surrounding said drilling slots, each production slot being adapted to receive a production riser after a well is completed at a drilling slot neighbour of said production slot, the plurality of drilling slots forming one opening inside the lower deck, a cart located between the upper and lower deck, said cart supporting a drilling riser and being movable together with said drilling riser inside said one opening of the plurality of the drilling slots, and a drilling rig located above the upper deck, said drilling rig being movable above the well bay so as to be positioned in alignment above the cart to allow to drill the well in using the drilling riser inside the drilling slot.

Thanks to these features, the drilling riser can be disconnected from a drilled and completed well, and it can be moved inside the well bay to another position without pulling out and without disconnecting all the tubes of the drilling riser. A lot of time is saved and the operations are less costly.

Additionally, the upper deck does not comprise any production device, and is free for installing the drilling tools.

Moreover, the wells can be drilled everywhere on the seafloor and according to a time sequence that is more flexible. A first well can be drilled at a first location on the seafloor, and a second well can be easily drilled after the first one even if this second well is positioned at a second location that is opposite to the first one.

In various embodiments of the facility, one and/or other of the following features may optionally be incorporated.

According to an aspect of the invention, the facility further comprises a blow out preventer device located inside the cart and connected above the drilling riser. The blow out preventer device can be moved by the cart together with the drilling riser without disconnecting it from the drilling riser.

According to an aspect of the invention, the cart is rested upon skid rails on the lower deck so as to be supported vertically above the lower deck and so as to be movable longitudinally according to a bay direction, and the cart is laterally in contact with longitudinal beams of the upper deck so as to be maintained laterally according to a lateral direction perpendicular to said bay direction.

According to an aspect of the invention, the drilling slots are aligned next to each other according to one bay direction.

According to an aspect of the invention, the well bay is arranged according to a matrix grid of slots having three rows and at least four columns, the outer slots being the production slots and the inner slots being the drilling slots.

According to an aspect of the invention, the matrix grid comprises more than six columns to provide at least four drilling slots and fourteen production slots.

According to an aspect of the invention, the production slots and the drilling slots have the same size.

According to an aspect of the invention, any drilling slot can be converted into a production slot by installing a rigid beam to close the slot and a production riser inside said converted drilling slot.

According to an aspect of the invention, the cart comprises a guiding assembly that guides the drilling riser inside the cart according to a riser direction. The drilling riser is able to move forth and back according to the riser direction.

According to an aspect of the invention, the facility further comprises a blow out preventer device located inside the cart and is connected above the drilling riser, so as said blow out preventer device can be moved by the cart together with the drilling riser without disconnecting it to the drilling riser, and the guiding assembly guides at least the drilling riser and the blow out preventer device together inside the cart according to the riser direction.

According to an aspect of the invention, the facility the cart comprises a tension assembly to maintain a tension force on the drilling riser that pulls up the drilling riser to the cart.

According to an aspect of the invention, the cart comprises a housing cage composed of a plurality of beams, and the guiding assembly comprises:

a connecting support extending inside the housing cage according to directions substantially perpendicular to said riser direction, being into sliding contact with lateral beams belonging to the housing cage, and being connected to the drilling riser via a tension ring secured to the drilling riser and extending laterally above the connecting support, and a guiding support connected to the blow out preventer device and extending inside the housing cage between said blow out preventer device to said lateral beams belonging to the housing cage, and said guiding support being into sliding contact with said lateral beams, and the tension assembly comprises at least one piston connected to said housing cage and said connecting support, said piston being controlled to generate said tension force.

Another object of the invention is to provide a method for drilling a well, wherein the method is implemented on a floating offshore facility for offshore hydrocarbon production, said offshore facility comprising:

an upper deck and a lower deck, a well bay located on the lower deck, said well bay being composed of a plurality of drilling slots and a plurality of production slots surrounding said drilling slots, each production slot being adapted to receive a production riser after a well is completed at a drilling slot neighbour of said production slot, the plurality of drilling slots forming one opening inside the lower deck, a cart located between the upper and lower deck, said cart supporting a drilling riser and being movable together with said drilling riser inside said one opening of the plurality of the drilling slots, and a drilling rig located above the upper deck, said drilling rig being movable above the well bay so as to be positioned in alignment above the cart to allow to drill the well in using the drilling riser inside the drilling slot, and wherein the method comprises the following initial steps:

moving the cart to a drilling slot, and positioning the drilling rig in alignment above the cart, and connecting the drilling riser to the well at the seafloor.

Thanks to these features, a plurality of wells can be drilled on a deep seafloor and an other plurality of wells can simultaneously provide a hydrocarbon production. A new well can be started to drill rapidly after a first one is completed and ready for production. The drilled positions of the well at the seafloor can be separated from each other of a wide distance. The number of wells connected to the facility can be increased.

In preferred embodiments of the method, one and/or other of the following features may optionally be incorporated.

According to an aspect of the invention, the method further comprises the following drilling steps after the initial steps:

drilling and completing a well from a drilling slot on the facility, disconnecting the drilling riser from said well at the seafloor, repeating the initial steps and the drilling steps with an other drilling slot for drilling an other well.

According to an aspect of the invention, the method further comprises the following production steps after the disconnecting step: installing a production riser at a production slot that is a neighbour of the drilling slot and connecting said production riser to the well at the seafloor that is completed and ready for hydrocarbon production.

According to an aspect of the invention, the facility further comprises a blow out preventer device located inside the cart and connected above the drilling riser, and during the initial steps of the method, moving the cart moves the drilling riser and the blow out preventer device together without disconnecting blow out preventer device from the drilling riser.

BRIEF DESCRIPTION OF THE DRAWINGS

Other features and advantages of the invention will be apparent from the following detailed description of one embodiment given by way of non-limiting example, with reference to the accompanying drawings. In the drawings.

MORE DETAILED DESCRIPTION

In the various Figures, the same reference numbers indicate identical or similar elements. The direction Z is a vertical direction. A direction X or Y is a horizontal or lateral direction. These are only indications for the understanding of the invention.

Figure 1:
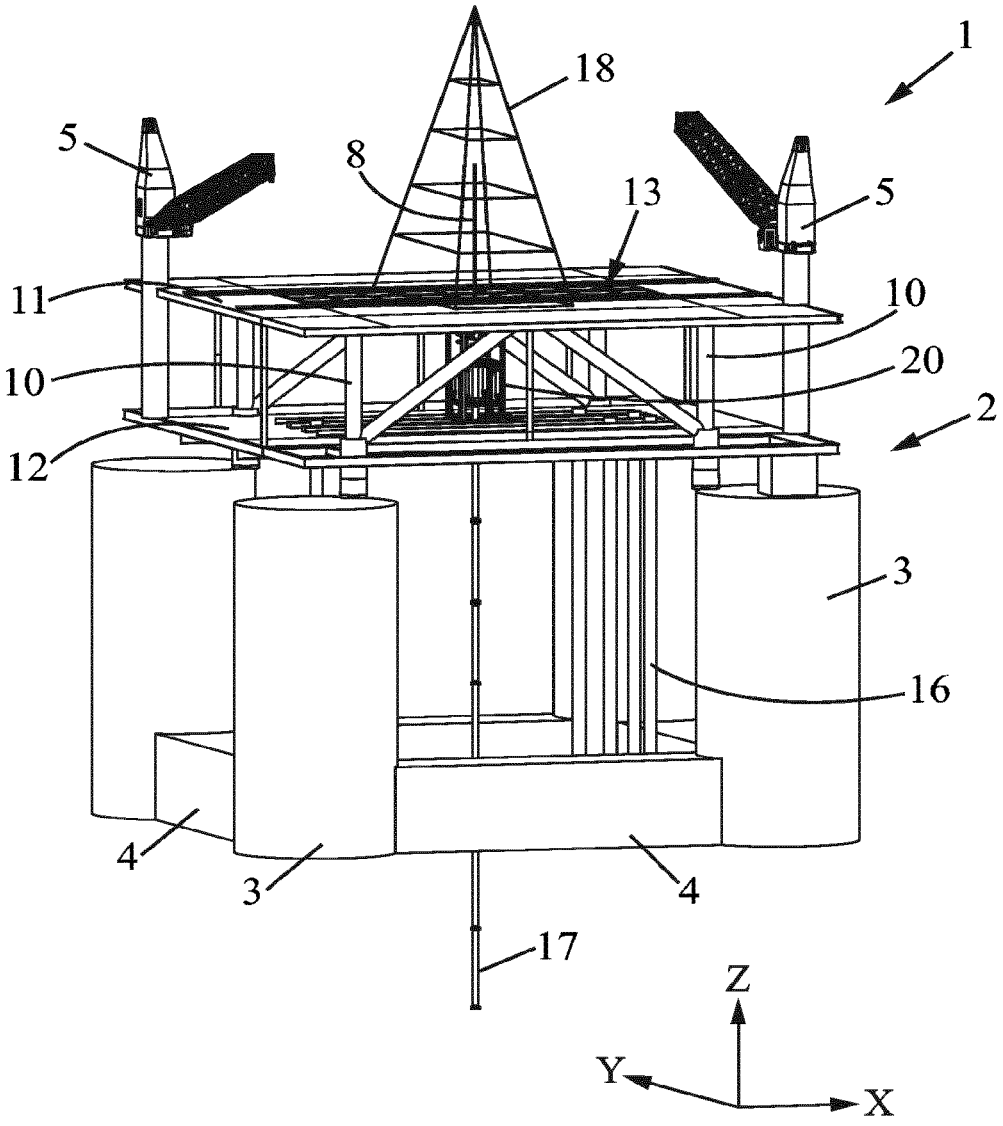
FIG. 1 is a perspective view of a floating offshore facility according to the invention.
Figure 2:
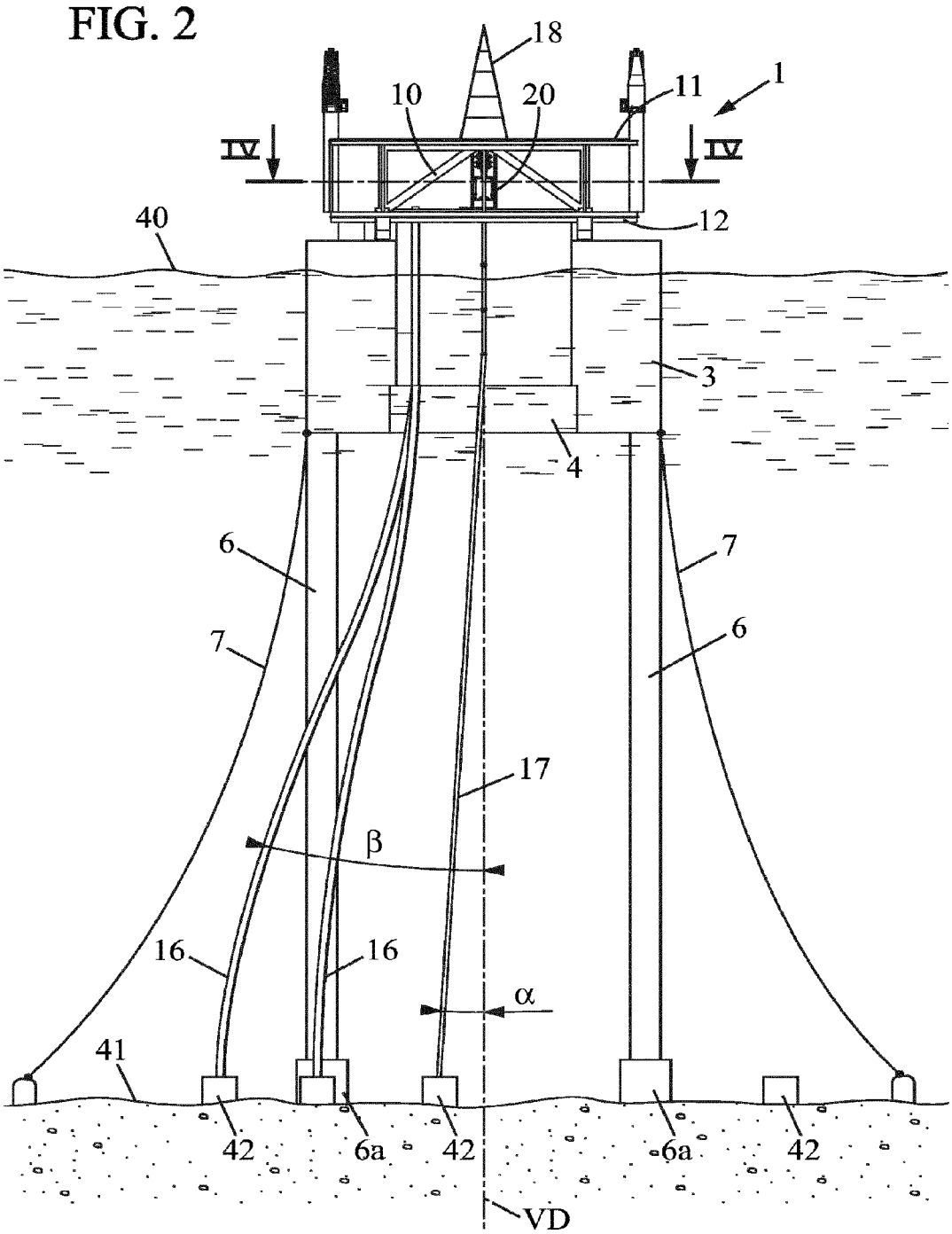
FIG. 2 is a side view of the facility of FIG. 1 shown in the sea and the drilling riser and a plurality of production risers extending from the facility to the wells at the seafloor.

The FIGS. 1 and 2 represent a floating offshore structure or facility 1 for offshore hydrocarbon production according to the invention. The facility 1 comprises a hull structure 2 supported above the sea water surface 40 by several (for example four of them) adjustable buoyancy column tanks 3. The column tanks 3 are connected one to another at their bottom ends by transversal beams 4, and at their top ends by decks 11, 12 that support the drilling, completion and production apparatus needed for the offshore hydrocarbon production. The hull structure 2 also comprises structure beams 10 that support at least an upper deck 11 and a lower deck 12.

The floating facility 1 is secured to the seafloor 41 by a set of rigid vertical tendons 6 made of pipe extending, for example from the column tanks 3 to the seafloor 41 where they are secured by foundations 6*a*. In addition back-up mooring lines 7 can be installed and controlled by winches to move the floating offshore facility 1 relative to the seafloor 41.

The upper deck 11 supports a drilling rig 18 that is operable for drilling the subsea wells 42 extending from the seafloor 41 to the hydrocarbon reservoir beneath the seafloor. The drilling is performed with a drill string 8 that is introduced into a drilling riser 17 from the drilling rig 18 and to the well. The upper deck 11 may also support many types of equipment, and for example one or more cranes 5.

The facility 1 according to the invention comprises a well bay 13 that is opened through the lower deck 12. The well bay 13 has for example a rectangular shape that extends mainly according to a bay direction BD. Other well bay shapes can be used.

The well bay 13 is composed of a plurality of regions that are adjacent one to another. These regions are called slots. The well bay 13 is for example arranged according to a matrix grid of slots.

The slots are at least of two kinds:

- drilling slots 14 arranged adjacent to each other, each drilling slot 14 being adapted for receiving a drilling riser 17, and
- productions slots 15, each production slot 15 being adapted for receiving a production riser 16.

The matrix grid may have three rows, and at least four columns. The outer slots of the grid are the production slots and the inner slots are the drilling slots.

The matrix grid may have for example more than six columns to provide four drilling slots 14 and fourteen production slots 15.

The plurality of drilling slots 14 forms a continuous opened opening in the lower deck 12. A device can be moved trough said opening from any of the drilling slots to any other of the drilling slots.

The plurality of production slots 15 is surrounding the plurality of drilling slots 14. For each drilling slot 14, there are several production slots 15 near said drilling slot 14.

Figure 4:
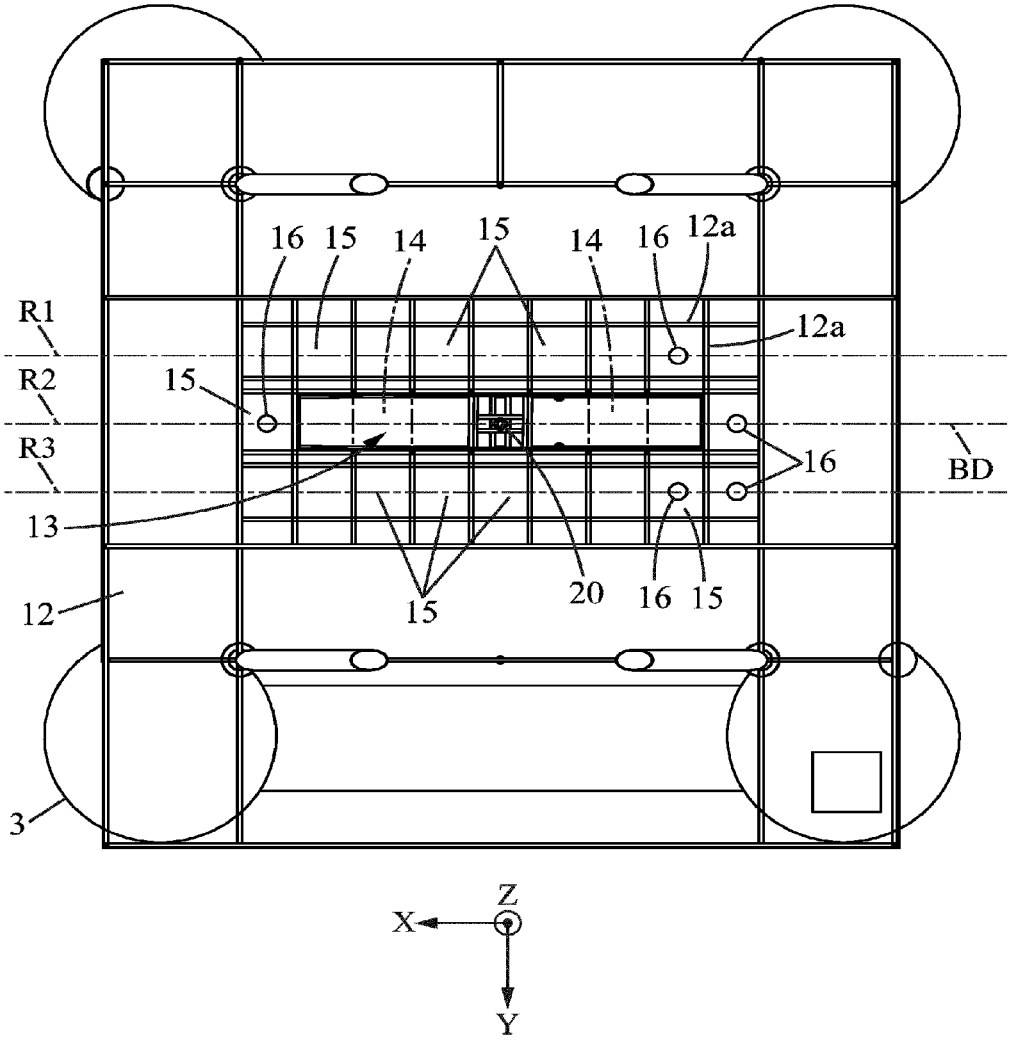
FIG. 4 is an upper cut view of the facility of FIG. 1, viewed between the upper and lower deck and showing the well bay in a more detailed manner.

As represented on the embodiment of FIG. 4, the well bay 13 is arranged according to a matrix grid of slots, comprising:

- three rows R1, R2, R3 parallel to the bay direction BD, and
- nine columns perpendicular to said bay direction.

The second row R2 (central raw) comprises seven slots being the drilling slots 14 and two slots at the ends of this central row R2 being production slots 15. The first and second rows R1, R3 only comprises productions slots 15.

The well bay therefore comprises a total of twenty production slots 14, i.e. approximately three production slots 15 for each drilling slot 14. The seven drilling slots 14 are surrounded by the twenty production slots 15.

All the slots (drilling and production slots) have the same shape and the same size. They are for example squares.

The production slots 15 are at least horizontally delimited on all sides by structure beams 12*a* belonging to the lower deck 12. The inner portion of each production slot 15 is opened through the lower deck 12 to install a production riser 16. Above the production riser 16 and the production slot 15 a wellhead is installed and all the tools needed for the extraction of hydrocarbon from the well connected to said production slot.

The drilling slots 14 are horizontally delimited by structure beams 12*a* belonging to the lower deck 12, only for sides that are adjacent to a production slot 15. There is no transversal structure beam 12*a* between two adjacent drilling slots 14. All the drilling slots 14 form an opening in the lower deck 12. In the embodiment of FIG. 4, said opening is a wide opening of seven drilling slots 15 that are aligned next to each other according to the bay direction BD in the second row R2. This opening is like a wide slit in the lower deck 12.

A drilling slot 14 can be converted into a production slot 15. A rigid beam is installed transversally at the open side of the drilling slot to close the slot and to convert it into a production slot. The opening of the well bay 13 is reduced in size. A drilling slot 14 at an end of the opening is firstly converted. The last drilling slot 14 to be converted is the drilling slot that is in the middle of the well bay. After the rigid beam is installed, the slot is converted: It has the same structure as a production slot 15, i.e. four beams; one at each side of the slot. A production riser 16 can then be installed inside the converted drilling slot as it is a production slot.

A drilling riser 17 is a tube that is installed between the facility 1 and the subsea well, and that is used for drilling the well, or a plurality of wells. Such drilling riser 17 is for example a tube having a diameter of 20 inches. It is usually composed of a plurality of tubes of approximately 24 meters long and that are linked one to an other adjacent one via joints or flanges. A drill string 8 is introduced into a drilling riser 17 from the drilling rig 18 to drill the well. Such drilling riser 17 is only used during a drilling period that can last for example three years. After this drilling period the drilling riser is not used.

As viewed on FIG. 2, a drilling riser 17 in use extends from the facility 1 to a well 42 at the seafloor 41. The drilling riser 17 forms a first angle $\alpha$ with a vertical direction VD that is small and the first angle is for example lower than 3°. On the Figures, the vertical direction corresponds to the Z direction.

A production riser 16 is a tube that is installed between the facility 1 and the subsea well, and that is used for extracting the hydrocarbon from the well to the facility 1. Such production riser 16 is not subjected to the drilling mechanical constraints and can be less resistant. Such production riser 16 is for example a tube having a diameter of 10 inches and ¾. It is composed of a plurality of tubes that are usually linked together via threaded ends. The production riser 16 is used during the production period of a well that can last more than thirty years.

A production riser 16 is less heavy than a drilling riser 17. However, a production riser 16 is more flexible than a drilling riser 17. The drill string 8 is rotating inside the drilling riser 17, and may cause friction and wear of the drilling riser 17 if it is bended too much.

A production riser 16 extends from the facility 1 to a completed well 42 at the seafloor. The production riser 16 forms a second angle $\beta$ with the vertical direction VD that can be greater than the first angle $\alpha$ of a drilling riser 17. The second angle $\beta$ is for example lower than 10°.

The facility 1 according to the invention also comprises a cart 20 that is located between the upper and lower decks 11, 12, and that can be moved from one drilling slot 14 to any other drilling slot 14 of the well bay. The cart 20 supports the drilling riser 17. The cart 20 can be moved through the opening of the plurality of drilling slots 14 without pulling out the drilling riser 17. The drilling riser 17 is only disconnected from the well 42. The cart 20 and drilling riser 17 are therefore movable together inside said opening of the well bay 13.

Thanks to these feature, the drilling riser 17 can be moved to any drilling slot 14. It can be moved to a chosen drilling slot that, from an upper view (as on FIG. 3), is nearer to the well position 42 that has to be drilled.

The cart 20 is for example rested upon skid rails 12*b* secured to the lower deck 12 for supporting it vertically and for facilitating a displacement of it longitudinally, according to the bay direction BD. The cart 20 is also for example in lateral contact with longitudinal beams 11*a* belonging to the upper deck 11 for maintaining it laterally according to a direction perpendicular to the bay direction.

The cart 20 is therefore enclosed inside the facility structure, between the upper and lower decks 11, 12, so as to be maintained therein and to be guided for a controlled displacement above the plurality of drilling slots 14.

The cart 20 can therefore transfer to the facility structure a high level of force coming from the action of the sea on the drilling riser 17.

Figure 5:
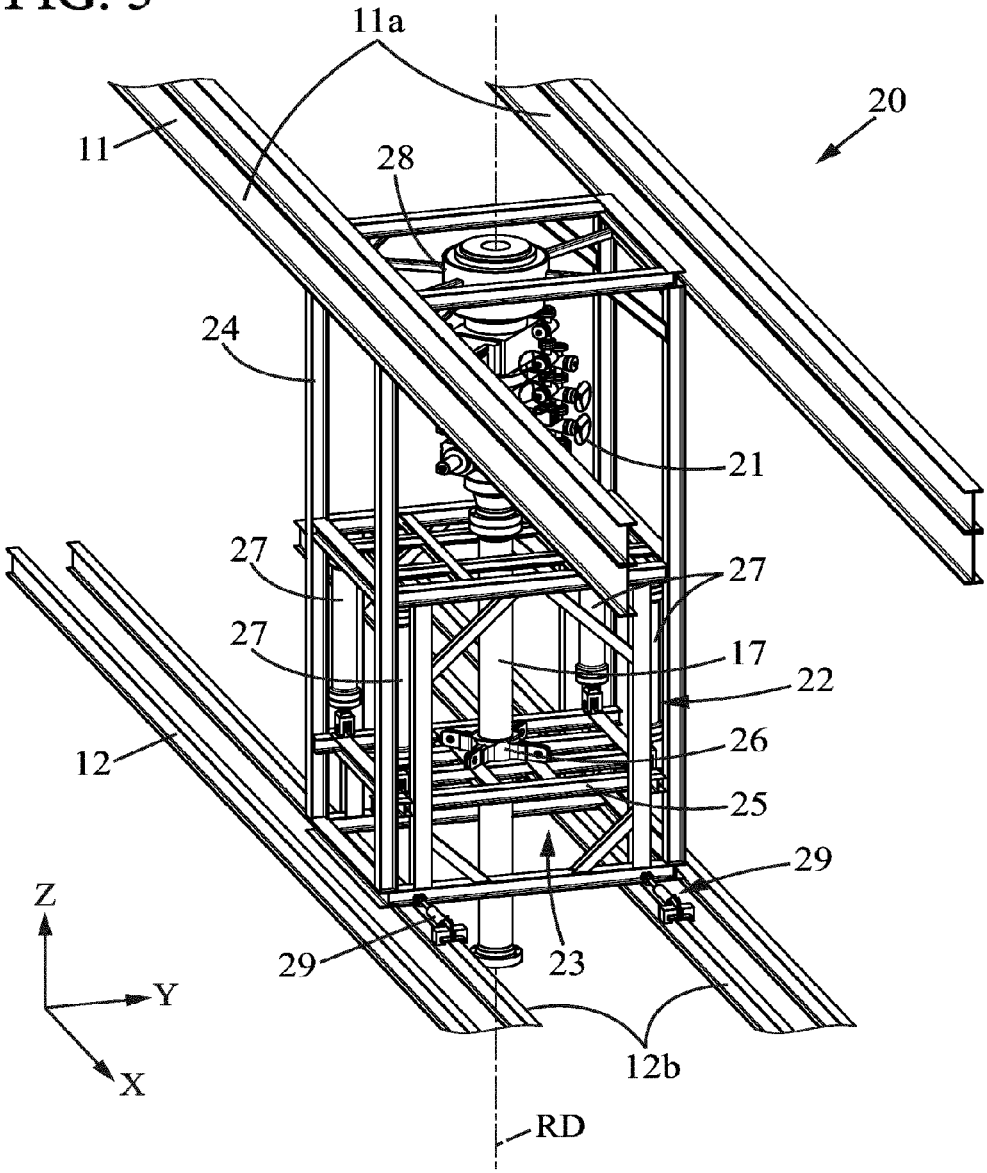
FIG. 5 is a perspective view of the cart included between the upper and lower deck of the facility of FIG. 1.

The facility 1 comprises cart actuators 29 (visible on FIG. 5) to control the displacement of the cart 20 on the skid rails 12*b*. It also comprises locking devices for rigidly securing the cart 20 to the facility structure after it has been displaced by the cart actuators to a determined drilling slot 14. The cart actuators 29 are of any kind: electric actuator, pneumatic actuator or hydraulic actuator.

The drilling rig 18 is also movable above the well bay 13, and it can be positioned on the upper deck 11 in alignment above the cart 20 to allow drilling a new well from said drilling slot 14 and by using the drilling riser 17 suspended inside the cart 20.

The drilling rig 18 can be moved on the upper deck 11 to be above any drilling slot 14, but also to be above any production slot 15 for a maintenance purpose.

The facility 1 comprises actuators to move the drilling rig 18 above the upper deck 11. These actuators can be controlled to move the drilling rig 18 according to one or two directions on the horizontal surface of the upper deck 11. These actuators may be hydraulic, pneumatic or electric actuators.

According to a preferred embodiment of the invention, a blow out preventer device 21 (BOP) can be included inside the cart 20.

A blow out preventer device 21 is a device comprising valves that is installed to seal the well in case of emergency and to avoid leak of hydrocarbon in the environment. The blow out preventer device 21 allows controlling and monitoring the hydrocarbon coming out of the well. In case of a TLP facility, the blow out preventer device is usually installed on the platform facility, in dry environment.

The BOP 21 is then always connected above the drilling riser 17. Connections and disconnections stages are avoided. The blow out preventer device 21 and the drilling riser 17 are therefore moved together by the cart 20, without any disconnection. A lot of time is saved when a well is completed and another well has to be started from another drilling slot 14: The cart 20 is moved between the drilling slots.

The BOP 21 is not disconnected from the drilling riser 17, and stays inside the cart 20. It is not stored above the upper deck 11 where it may block the way on the upper deck, especially for the drilling rig 18 operations. The BOP 21 is itself well stored inside the cart 20 between the upper and lower decks.

The BOP 21 is a sealing device that makes the well safe. The BOP 21 is protected inside the cart 20 against any accident or damage.

The facility 1 is tethered to the seafloor 41 by the tendons 6 and the drilling riser 17 is subjected to the sea influence and movement between the seafloor and the facility. In use, there may be relative displacement between the drilling rise 17 and the facility 1.

The cart 20 further comprises a guiding assembly 23 that guides the drilling riser 17 or the drilling riser 17 together with the BOP 21, inside the cart 20 according to a riser direction RD.

The cart 20 is comprises:

a housing cage 24 composed of a plurality of beams, the housing cage forms a substantially parallelepiped cage that surrounds and covers the drilling riser 17 and the BOP 21; and a connecting support 25 having a form of a platform that extends inside the housing cage according to directions perpendicular to the riser direction RD, said connecting support being in into sliding contact with lateral beams of the housing cage and extending according to the riser direction RD.

A tension ring 26 is secured to the drilling riser 17 above the connecting support 25. This tension ring 26 extends laterally and is linked securely to the connecting support 25. The drilling riser 17 is therefore secured to the connecting support 25 that is able to slide back and forth inside the housing cage 24 according to the riser direction RD.

In case, the cart 20 includes the BOP 21, the cart 20 also comprises a guiding support 28 connected to the BOP 21 and extending according directions perpendicular to the riser direction RD inside the housing cage 24 between the BOP 21 and the lateral beams of the housing cage 24. The guiding support 28 is in sliding contact with the lateral beams of the housing cage. The BOP 21 is therefore guided in displacement inside the housing cage 24 according to said riser direction RD.

Both of the connecting support 25 and the guiding support 28 contribute to guide the displacements of the drilling riser 17 inside the cart 20. The cart 20 may also comprises any other element to guide the displacement of the drilling riser inside the cart.

The riser direction RD can be parallel to the vertical direction VD of the facility 1. However, it may be inclined relative to said vertical direction.

The cart 20 further comprises a tension assembly 22 that maintains a tension force on the drilling riser 17 according to the riser direction RD. This tension force is a force of traction that pulls up the drilling riser to the facility 1 so as to keep the drilling riser 17 into a state of traction.

The tension assembly 22 may comprise for example four pistons 27 connected at one end to the housing cage 24 and at the other end to the connecting support 25. The pistons 27 are therefore pulling the connecting support 25 upward, i.e. toward the upper deck 11. The housing cage 24 transmits the force to the lower deck 11.

The pistons 27 are for example hydraulic pistons.

A new method for drilling a well will know be explained. The method uses any one or any combination of the embodiments of the facility 1 as above described.

The facility 1 used in the method at least comprises the following features:

an upper deck 11 and a lower deck 12, a well bay 13 located on the lower deck, the well bay being composed of a plurality of drilling slots 14 and a plurality of production slots 15 surrounding said drilling slots, each production slot being adapted to receive a production riser 16 after a well is completed at a drilling slot neighbour of said production slot, the plurality of drilling slots forming one opening inside the lower deck, a cart 20 located between the upper and lower deck, said cart supporting a drilling riser 17 and being movable together with said drilling riser inside said one opening of the plurality of the drilling slots, and a drilling rig 18 located above the upper deck, said drilling rig being movable above the well bay so as to be positioned in alignment above the cart to allow to drill the well in using the drilling riser inside the drilling slot.

Figure 6:
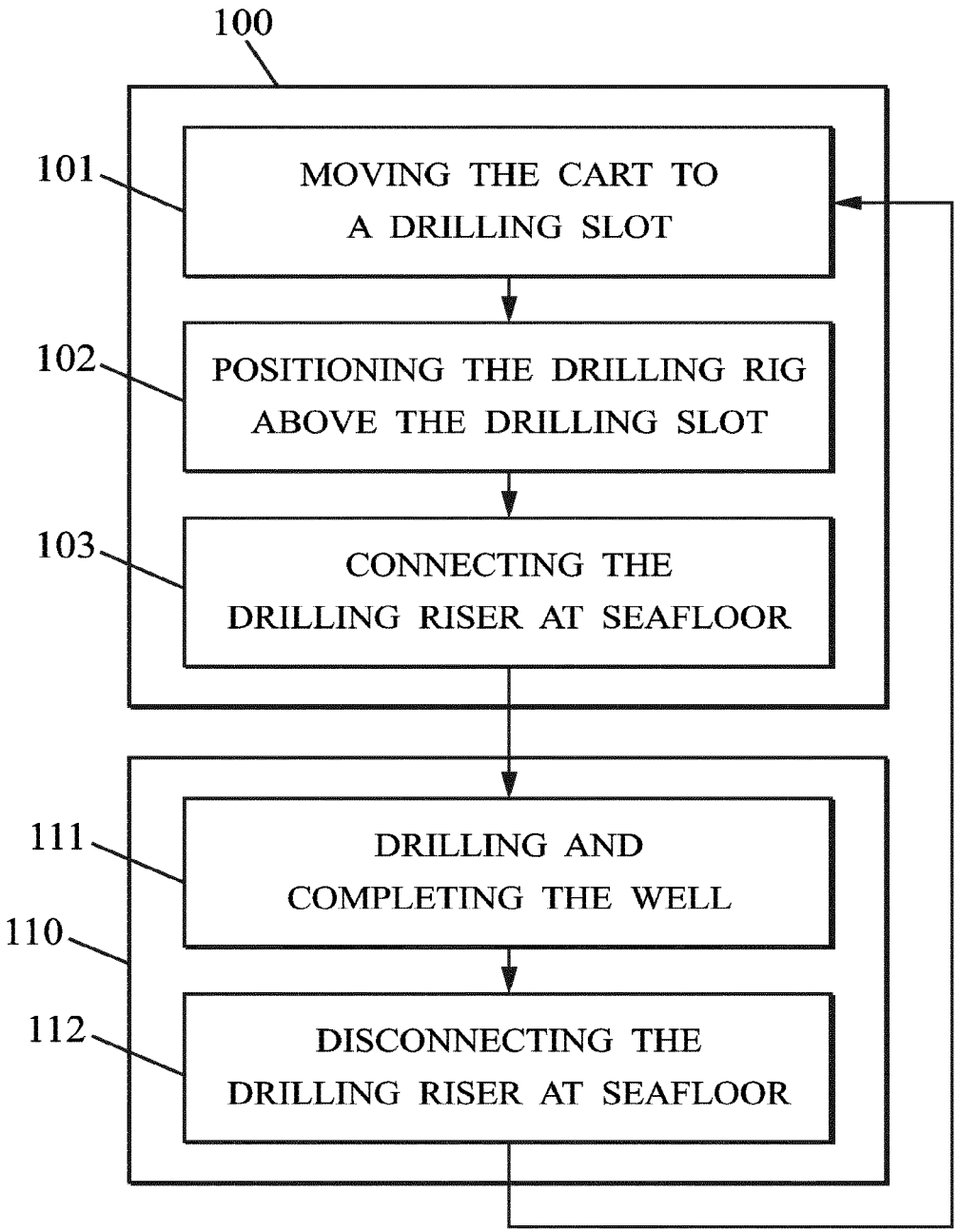
FIG. 6 is a flowchart presenting the method for drilling a well that uses the facility of FIG. 1.

As shown on FIG. 6, the method comprises at lest the following initial steps 100:

moving 101 the cart to a drilling slot 14, and positioning 102 the drilling rig 18 in alignment above the cart 20, and connecting 103 the drilling riser 17 to the well at the seafloor.

During the moving step 101, the cart 20 moves the drilling riser 17 to a predetermined drilling slot 14. The drilling riser 17 is therefore moved from the facility 1 from a first drilling slot to a second drilling slot, without pulling out all the tubes of the drilling riser 17, and without storing these tubes on the facility structure.

Thanks to the above method, a lot of time is saved, and a second well can be drilled from the second drilling slot just after the first well is drilled and completed.

Figure 3:
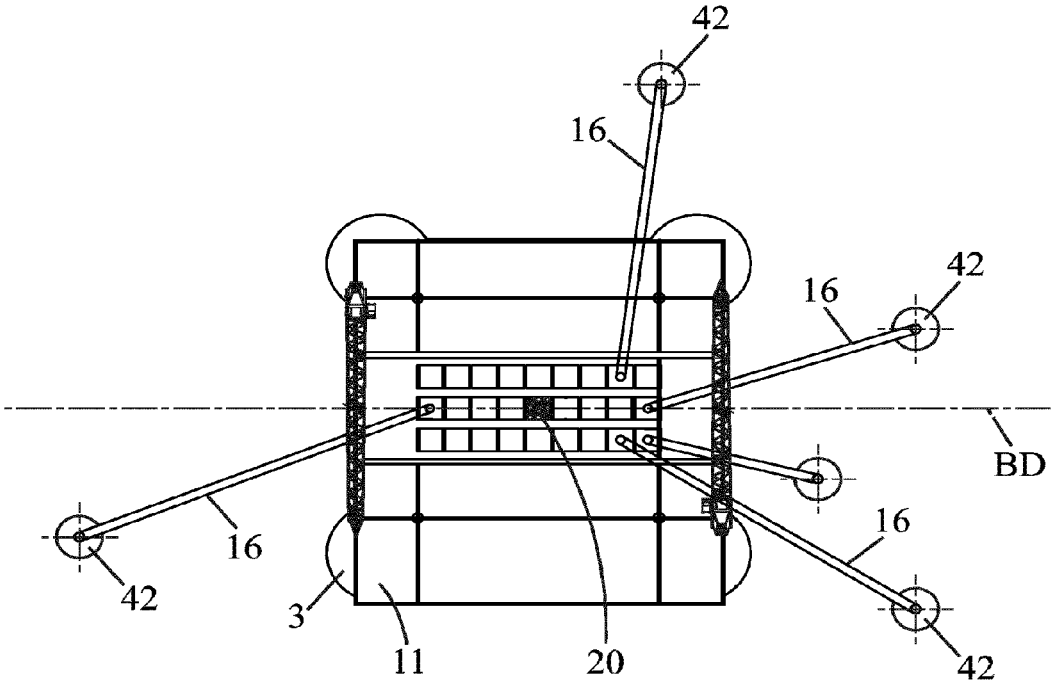
FIG. 3 is a top view of the FIG. 2 showing the wells locations around the facility according to horizontal directions.

Moreover, the drilling riser 17 can be moved across the opening of the well bay to drill wells that are separated from one to another of a wide distance as it can be seen on the upper view of FIG. 3.

To drill such wells, the drilling riser 17 is bended of a first angle $\alpha$ that is much lower than the second angle $\beta$.

It is therefore possible to have a floating offshore facility 1 that manages a high number of wells, and for example more than fourteen wells.

The method may also preferably comprise the following drilling steps 110 after the initial steps 100:

drilling 111 and completing a well from a drilling slot 14 on the facility, disconnecting 112 the drilling riser 17 from said well at the seafloor, and wherein the initial steps 100 and the above drilling steps 110 are repeated with an other drilling slot 14 for drilling an other well. The other drilling slot is a second drilling slot that is different from the first drilling slot (the drilling slot at the first loop).

Thanks to the above steps, the drilling riser 17 is only disconnected at the seafloor 41, without pulling it out of the sea and without disconnecting it from the cart 20. A lot of time is saved.

Additionally, the method further comprises at least a production step after the disconnecting step 112, said production step being operated in parallel to the drilling steps and/or initial step: installing a production riser at a production slot that is a neighbour of the drilling slot and connecting said production riser to the well at the seafloor that is completed and ready for hydrocarbon production.

A production slot 15 that is a neighbour of a drilling slot 14 is for example a production slot 15 that comprises a side or a corner in contact with the drilling slot.

It may be a production slot that is located at a distance from the drilling slot 14 that is lower than a predetermined distance. For example, in case the slot has a square shape, the predetermined distance is about a side size of a slot, or twice said side size.

Depending on the flexibility or bending ability of the used production riser 16, any production slot 15 of the well bay may be used for installing the production riser 16 that is connected to the currently drilled and completed well from the drilling slot 14.

As it can be understood from FIG. 3, the drilling slot is preferably chosen so as the first angle $\alpha$ of the drilling riser 17 is the lowest as possible. The fiction inside the riser during drilling is therefore limited and reduced.

A drilling sequence of the complete plurality of wells may be predetermined before drilling the first well, and thanks to the invention, this sequence may be adapted during the drilling of the wells of the sequence.

Optionally, the cart 20 includes a blow out preventer device 21. The BOP 21 is located inside the cart 20 and connected above the drilling riser 17, and during the initial steps 100 of the method, the step of moving 101 the cart moves the drilling riser 17 and the blow out preventer device 21 together without disconnecting blow out preventer device 21 from the drilling riser 17.

The embodiments above are intended to be illustrative and not limiting. Additional embodiments may be within the claims. Although the present invention has been described with reference to particular embodiments, workers skilled in the art will recognize that changes may be made in form and detail without departing from the spirit and scope of the invention.

Various modifications to the invention may be apparent to one of skill in the art upon reading this disclosure. For example, persons of ordinary skill in the relevant art will recognize that the various features described for the different embodiments of the invention can be suitably combined, un-combined, and re-combined with other features, alone, or in different combinations, within the spirit of the invention. Likewise, the various features described above should all be regarded as example embodiments, rather than limitations to the scope or spirit of the invention. Therefore, the above is not contemplated to limit the scope of the present invention.

The invention claimed is:

1. A floating offshore facility for offshore hydrocarbon production, wherein the offshore facility comprises:

an upper deck and a lower deck, a well bay located on the lower deck, said well bay being composed of a plurality of drilling slots and a plurality of production slots surrounding said drilling slots, each production slot being adapted to receive a production riser after a well is completed at a drilling slot neighbour of said production slot, the plurality of drilling slots forming one opening inside the lower deck, a cart located between the upper and lower deck, said cart supporting a drilling riser and being movable together with said drilling riser inside said one opening of the plurality of the drilling slots, and a drilling rig located above the upper deck, said drilling rig being movable above the well bay so as to be positioned in alignment above the cart to allow to drill the well in using the drilling riser inside the drilling slot.

2. The facility according to claim 1, further comprising a blow out preventer device located inside the cart and connected above the drilling riser so as said blow out preventer device can be moved by the cart together with the drilling riser without disconnecting it from the drilling riser.

3. The facility according to claim 1, wherein the cart is rested upon skid rails on the lower deck so as to be supported vertically above the lower deck and so as to be movable longitudinally according to a bay direction, and wherein the cart is laterally in contact with longitudinal beams of the upper deck so as to be maintained laterally according to a lateral direction perpendicular to said bay direction.

4. The facility according to claim 1, wherein the drilling slots are aligned next to each other according to one bay direction.

5. The facility according to claim 1, wherein the well bay is arranged according to a matrix grid of slots having three rows and at least four columns, the outer slots being the production slots and the inner slots being the drilling slots.

6. The facility according to claim 5, wherein the matrix grid comprises more than six columns to provide at least four drilling slots and fourteen production slots.

7. The facility according to claim 1, wherein the production slots and the drilling slots have the same size.

8. The facility according to claim 1, wherein any drilling slot can be converted into a production slot by installing a rigid beam to close the slot and a production riser inside said converted drilling slot.

9. The facility according to claim 1, wherein the cart comprises a guiding assembly that guides the drilling riser inside the cart according to a riser direction, so as the drilling riser is able to move forth and back according to said riser direction.

10. The facility according to claim 9, further comprising a blow out preventer device located inside the cart and connected above the drilling riser, so as said blow out preventer device can be moved by the cart together with the drilling riser without disconnecting it to the drilling riser, and wherein the guiding assembly guides at least the drilling riser and the blow out preventer device together inside the cart according to said riser direction.

11. The facility according to claim 9, wherein the cart comprises a tension assembly to maintain a tension force on the drilling riser that pulls up the drilling riser to the cart.

12. The facility according to claim 11, wherein the cart comprises a housing cage composed of a plurality of beams, and wherein the guiding assembly comprises:

a connecting support extending inside the housing cage according to directions substantially perpendicular to said riser direction, being into sliding contact with lateral beams belonging to the housing cage, and being connected to the drilling riser via a tension ring secured to the drilling riser and extending laterally above the connecting support, and a guiding support connected to the blow out preventer device and extending inside the housing cage between said blow out preventer device to said lateral beams belonging to the housing cage, and said guiding support being into sliding contact with said lateral beams, and wherein the tension assembly comprises at least one piston connected to said housing cage and said connecting support, said piston being controlled to generate said tension force.

13. A method for drilling a well, wherein said method is implemented on a floating offshore facility for offshore hydrocarbon production, said offshore facility comprising:

an upper deck and a lower deck, a well bay located on the lower deck, said well bay being composed of a plurality of drilling slots and a plurality of production slots surrounding said drilling slots, each production slot being adapted to receive a production riser after a well is completed at a drilling slot neighbour of said production slot, the plurality of drilling slots forming one opening inside the lower deck, a cart located between the upper and lower deck, said cart supporting a drilling riser and being movable together with said drilling riser inside said one opening of the plurality of the drilling slots, and a drilling rig located above the upper deck, said drilling rig being movable above the well bay so as to be positioned in alignment above the cart to allow to drill the well in using the drilling riser inside the drilling slot, and wherein the method comprises the following initial steps:

moving the cart to a drilling slot, and positioning the drilling rig in alignment above the cart, and connecting the drilling riser to the well at the seafloor.

14. The method according to claim 13, further comprising the following drilling steps after the initial steps:

drilling and completing a well from a drilling slot on the facility, and disconnecting the drilling riser from said well at the seafloor, and wherein the initial steps and the above drilling steps are repeated with an other drilling slot for drilling an other well.

15. The method according to claim 14, further comprising the following production steps after the disconnecting step: installing a production riser at a production slot that is a neighbour of the drilling slot and connecting said production riser to the well at the seafloor that is completed and ready for hydrocarbon production.

16. The method according to claim 13, wherein the facility further comprises a blow out preventer device located inside the cart and connected above the drilling riser, and wherein during the initial steps of the method, moving the cart moves the drilling riser and the blow out preventer device together without disconnecting blow out preventer device from the drilling riser.

* * * * *